United States Patent [19]

Camitz et al.

[11] 4,408,747

[45] Oct. 11, 1983

[54] DEVICE AND METHOD FOR COLLECTING CHAINS OR THE LIKE

[75] Inventors: Carl-Henning Camitz; Stig Lindgren, both of Ramnäs, Sweden

[73] Assignee: Bulten-Kanthal AB, Hallstahammar, Sweden

[21] Appl. No.: 183,673

[22] Filed: Sep. 2, 1980

Related U.S. Application Data

[63] Continuation of Ser. No. 36,468, May 7, 1979, abandoned, which is a continuation of Ser. No. 864,037, Dec. 23, 1977, abandoned.

[30] Foreign Application Priority Data

Dec. 30, 1976 [SE] Sweden ..... 7614747

[51] Int. Cl.[3] ..... B66D 1/72; B65H 54/80

[52] U.S. Cl. ..... 254/382; 242/82; 493/411

[58] Field of Search ..... 254/382, 372, 371; 242/82, 83, 84; 53/116; 72/426; 140/2; 493/411, 413, 414, 415, 448; 28/289

[56] References Cited

U.S. PATENT DOCUMENTS

| | | | |
|---|---|---|---|
| 405,433 | 6/1889 | Rusbatch | 242/82 |
| 412,482 | 10/1889 | Denn | 242/82 |
| 2,579,563 | 12/1951 | Gallinger | 254/382 X |
| 3,341,911 | 9/1967 | Smith | 28/289 X |
| 3,351,992 | 11/1967 | Carter | 53/116 |
| 3,378,898 | 4/1968 | Mendes | 53/116 |
| 3,509,687 | 5/1970 | Fleissner | 53/116 |
| 3,765,614 | 10/1973 | Bartl et al. | 242/82 X |
| 3,793,904 | 2/1974 | Grable | 254/382 X |
| 3,917,229 | 11/1975 | Ayme | 254/382 X |

FOREIGN PATENT DOCUMENTS

| | | | |
|---|---|---|---|
| 1082215 | 5/1960 | Netherlands | 242/82 |
| 693032 | 6/1953 | United Kingdom . | |

*Primary Examiner*—John M. Jillions

*Attorney, Agent, or Firm*—Pollock, Vande Sande & Priddy

[57] ABSTRACT

A device for collecting chains or the like in a manner suitable for storage and/or transport. A chain guide is adapted to be displaced, while the chain is fed, e.g., from a chain manufacturing plant, over a collection station along a cyclically repeated movement path, so that the chain hanging freely from the chain guide is laid down at the collection station in a number of well-defined loops.

5 Claims, 2 Drawing Figures

DEVICE AND METHOD FOR COLLECTING CHAINS OR THE LIKE

STATEMENT OF RELATED APPLICATIONS

This is a continuation of U.S. Application Ser. No. 036,468, filed May 7, 1979, abandoned, itself a continuation of U.S. Application Ser. No. 864,037 filed Dec. 23, 1977, abandoned.

BACKGROUND OF THE INVENTION

The invention relates to a device for collecting chains, in particular coarse and heavy chains, such as anchor chains, in a manner suitable for storage and/or transport.

When manufacturing a heavy chain, the latter is usually collected in a disordered pile, either on the floor of the plant or in a large transport container, a railroad car or the like. Especially extremely long chains will cause problems of reloading, since the entire chain can only be lifted by means of lifting devices having an extremely high lifting capacity. Further, it is difficult to get a good hold on a disordered chain pile by means of lifting hooks, straps or other lifting means. Thus, in many cases, it may be necessary to feed the entire chain in a stretched condition during the reloading operation, thereby requiring special feeding means, which are time consuming, complicated and expensive.

The main object of the invention is to provide a device which permits simplified handling of a chain by way of collecting the same in an organized manner.

SUMMARY OF THE INVENTION

This object is achieved by a device according to the invention, comprising a movable chain guide which is moved along a cyclically repeated movement path above a collection station, so that the chain hanging freely from the chain guide is laid down in well-defined loops, which can easily be lifted in desired units, e.g., by means of a lifting strap, a hoisting beam or the like pre-positioned right underneath the loops perpendicularly to their longitudinal direction. The number of loops in these units can be adapted to the transport or lifting means available up to the point of final use, whereby even very long chains can be reloaded as a "centipede" by means of existing, ordinary lifting devices.

By means of a chain guide disposed on an arm which is pivoted back and forth around a vertical shaft, the feeding of the chain can be effected by means of a stationary feeding device, e.g., a feeding wheel placed on a stand, adjacent to the pivot axis of the arm. This simplifies the mounting and operation of the feeding device.

Such a pivotable arm is preferably a downwardly inclined chute, the top of which is aligned with the feeding wheel. This obviates the need for a guide wheel at the free end of the arm, from which the chain falls out, since the chain can travel along the chute and freely hang down from the free end thereof to the underlying surface.

In order to form ordered loops, the guide must be moved along the cyclically repeated path, e.g., a circular arc in case the guide is formed by a pivotable arm, an ellipse or some other, preferably elongated, closed curve, at a speed substantially corresponding to the feeding rate of the chain, so that the chain does not drag on the supporting surface or is stacked into a disordered pile. This condition is especially important at the center of the loops under which a lifting strap or some other elongated lifting means, such as a beam, has been pre-positioned. The displacement of the guide need not be performed at a uniform velocity but can proceed be step-wise, for example in synchronism with linkwise feeding of the chain from a production line or a work station.

The invention will be explained more fully below with reference to the drawings.

DESCRIPTION OF PREFERRED EMBODIMENT

Figure 1:
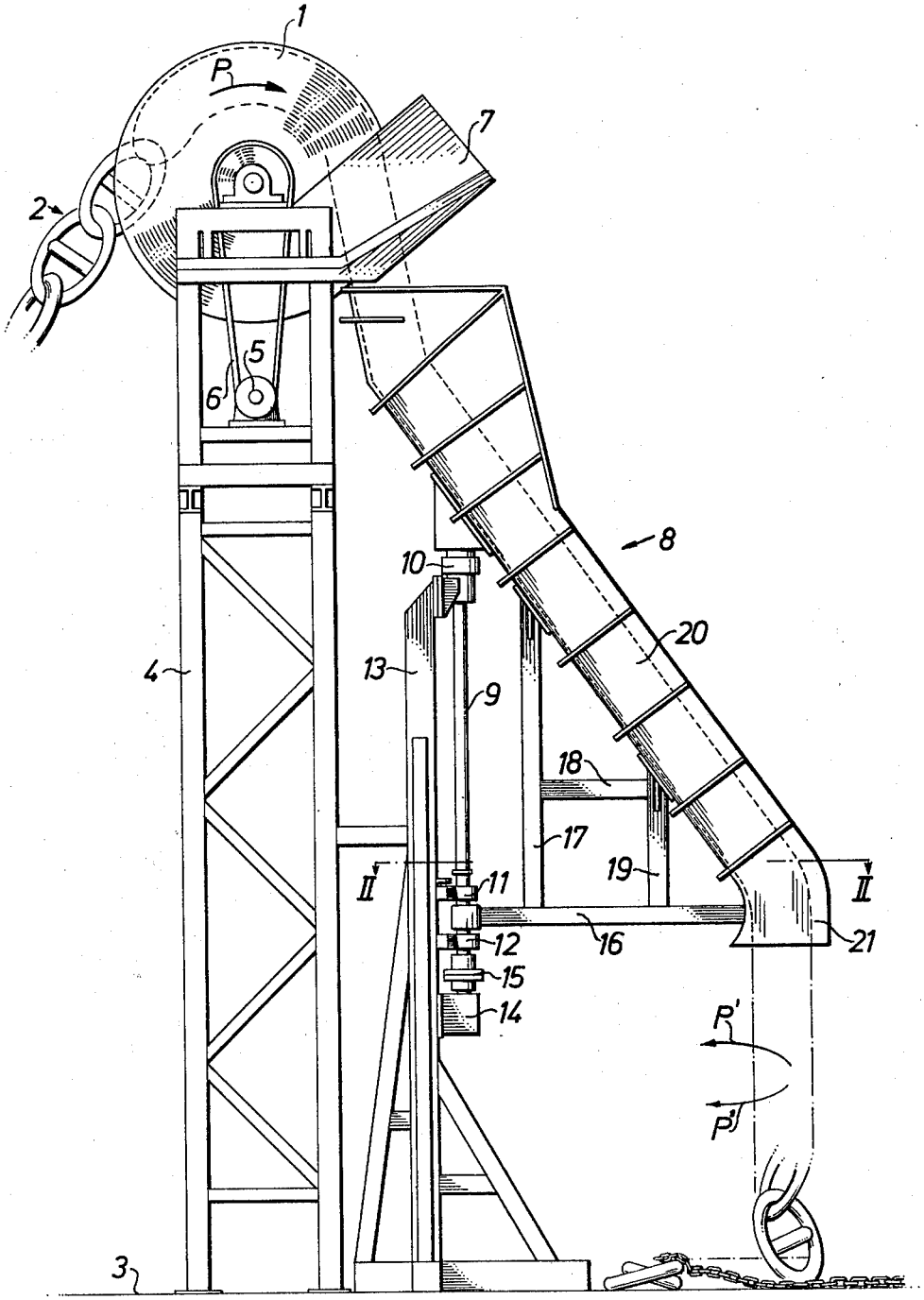
FIG. 1 shows schematically, in elevational view, a device according to the invention with a chain guide in the form of a pivotable arm.

A feeding wheel 1 for feeding a heavy chain 2 is mounted in bearings at the top of a stand 4 about 7 meters above the floor level 3. The wheel 1 is driven in the direction of the arrow P by means of a schematically shown motor 5 and a transmission 6, e.g., in synchronism with the production of the chain. In alignment with the output side of the wheel 1, where fixed side guide plates 7 are arranged, an arm 8 is pivotally mounted on a vertical axis 9 which is rotatably journalled in upper and lower bearings 10 and 11, 12, respectively, disposed on a separate stand 13 connected to the wheel stand 4. The axis 9 and the arm 8 coupled rigidly thereto are drivable in alternating directions of rotation and pivoting, respectively, by means of a schematically shown hydraulic motor 14 via coupling 15. The arm 8 comprises a vertically oriented frame 16–19 carrying a substantially U- or box-shaped chute 20, which is inclined downwards from the feeding wheel 1 and ends with a vertically downwardly bent, somewhat widened end portion 21 about 2 meters above the floor. When the feeding wheel 1 is operating, the chain, under the influence of gravity, travels downwards in the chute 20 and down to the floor 3. Simultaneously, the arm 8 with the chute 20 is pivoted around the axis 9, as indicated by the arrows P′ in FIGS. 1 and 2. The pivotal movement is performed at a horizontal speed which substantially corresponds to the peripherical speed of the feeding wheel 1, i.e., the feeding speed of the chain, so that the chain is placed on the floor 3 link by link and is neither dragged nor stacked in a disordered manner.

Figure 2:
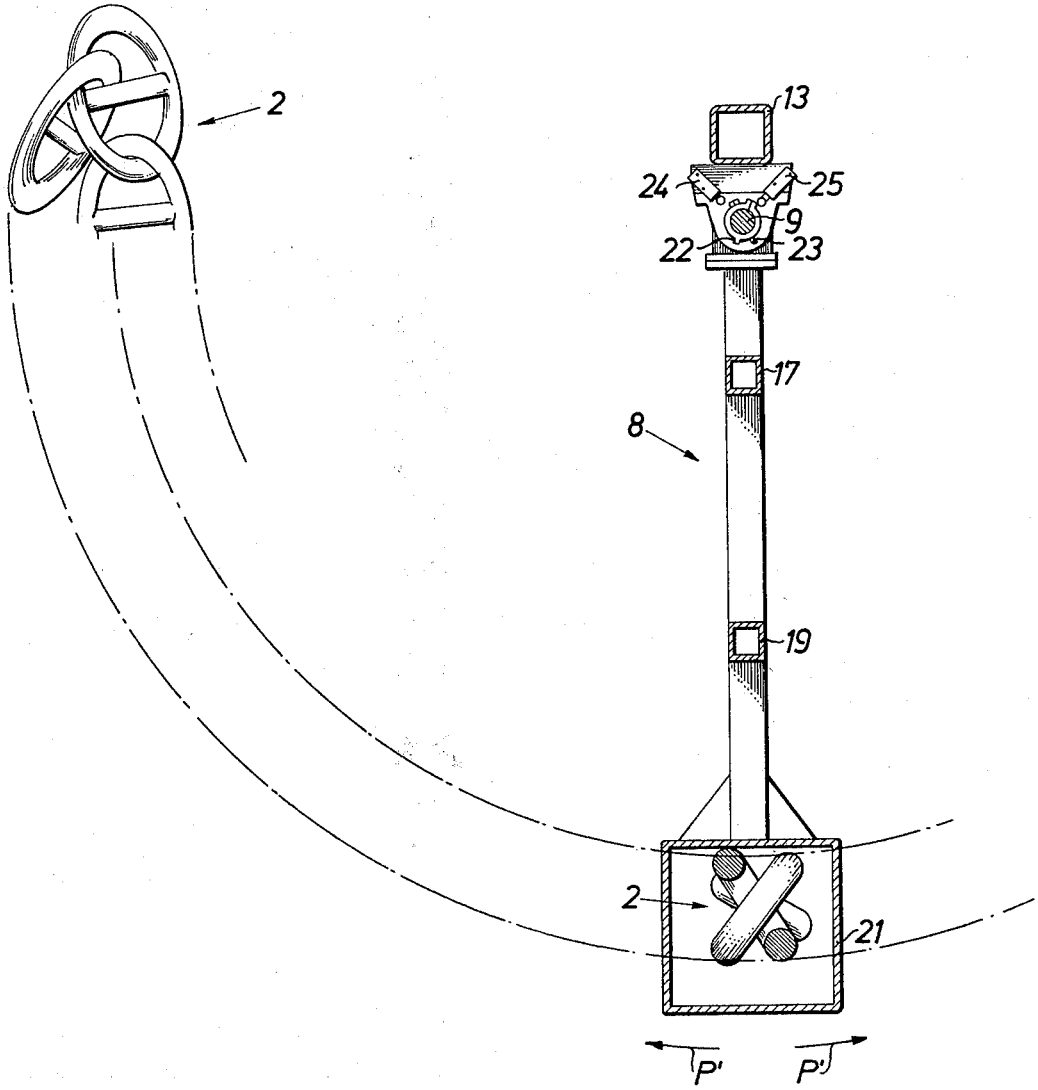
FIG. 2 shows a section along the line II—II in FIG. 1.

As indicated in FIG. 2, the axis 9 is provided with two cams 22,23 which are adjustable circumferentially, each of these cams being adapted to actuate a corresponding limit switch 24 and 25, respectively, which controls the rotary direction of the hydraulic motor 14 by means of an ordinary directional valve (not shown). Thus, the arm 8 will switch its direction of pivotal movement at desired, adjustable angular positions and will perform a reciprocal pivotal movement. Hereby, the chain is placed in well defined, circularly arcuate loops, one on top of the other. By pre-positioning a lifting strap or the like on the floor 3, radially under the arm 8 in its positions shown in FIG. 2, and laying down a desired number of chain loops, one can connect the ends of the lifting strap with a lifting means and, during possible further feeding of a continuous length of the chain over feeding wheel 1, lift away the chain unit thus collected in loops to a desired storage place. Thus, a great length of a chain can be stored and transported in a desired number of ordered units with adequate chain lengths therebetween.

It should be pointed out that the invention can be applied in different ways within the scope of the inventive idea. Thus, the chain guide can be adapted to perform any kind of cyclically repeated movement path, e.g., along a straight line, an ellipse, an "eight" or any other preferably continuous and at least substantially closed curve.

Furthermore, the feeding wheel 1 or some other feeding means can be provided at the movable chain guide, which can also be provided with one or more freely rotatable guide wheels, if necessary, to reduce friction.

Thus, the essential feature is that the chain guide operates synchronously (continuously or intermittently) with the feeding of the chain in such a way that the chain is placed at the collection station in well-defined loops.

We claim:

1. A device for collecting coarse and heavy chains in a manner suitable for storage and transportation, comprising (a) means for feeding a chain at a predetermined rate of speed;

(b) chain guide means for receiving said chain from said feeding means, and pivotable about a substantially vertical axis for motion above a non-rotatable stationary support means at which said chain is to be collected, said support means comprising a means upon which said chain is deposited link by link for subsequent transport;

(c) means for pivotally reciprocating said chain guide means over said support means along a circular arc of less than 180° between two terminal positions; and (d) means for synchronizing the speed of reciprocation of said chain guide means with said predetermined rate of speed;

(e) whereby the portion of said chain emerging freely from said chain guide means is deposited link by link at said support means in a plurality of well-ordered elongated loops.

2. A device according to claim 1, wherein said chain guide is mounted on an arm which is pivotable back and forth about a vertical axis.

3. A device according to claim 2, wherein said arm is provided with a downwardly inclined chute for said chain.

4. A device according to claim 1, comprising a stationary chain feeding wheel mounted at a higher level than said chain guide.

5. A method of collecting coarse, heavy chain in a manner suitable for storage and transportation, comprising the steps of (a) feeding said chain at a predetermined rate of speed from a stationary feeding device into a downwardly inclined chute member;

(b) pivotally reciprocating said chute member about a vertical axis in a predetermined circular arc of less than 180° between two terminal positions, substantially in synchronization with the feeding of said chain;

(c) providing a stationary support means beneath said chute, (d) whereby said chain moves through said chute member and is deposited therebeneath on said stationary support means link by link in a series of well-ordered, elongated loops suitable for transport.

* * * * *